US006053115A

United States Patent [19]

Felton

[11] Patent Number: 6,053,115

[45] Date of Patent: Apr. 25, 2000

[54] SUPPORT AND RELATED SHELF

[75] Inventor: J. Reed Felton, Milwaukee, Wis.

[73] Assignee: Versatile Products LLC, Menomonee Falls, Wis.

[21] Appl. No.: 09/209,501

[22] Filed: Dec. 11, 1998

[51] Int. Cl.[7] ..... A47B 9/00

[52] U.S. Cl. ..... 108/107; 108/110

[58] Field of Search ..... 108/106, 107, 108/110, 144.11, 147.16, 147.17; 211/107, 190, 191, 208, 207, 193

[56] References Cited

U.S. PATENT DOCUMENTS

| | | | |
|---|---|---|---|
| 597,186 | 1/1898 | Hunter | 108/110 |
| 605,291 | 6/1898 | Hunter | 108/110 |
| 1,080,293 | 12/1913 | Dungan | 108/107 |
| 1,805,989 | 5/1931 | Levene . | |
| 1,990,756 | 2/1935 | Saaf | 211/148 |
| 2,070,174 | 2/1937 | Pace | 312/185 |
| 2,700,476 | 1/1955 | Maintain | 211/136 |
| 2,959,294 | 11/1960 | Rosenquist et al. | 211/45 |
| 3,113,818 | 12/1963 | Armentrout et al. | 312/298 |
| 3,132,602 | 5/1964 | Chesley | 108/106 |
| 3,266,635 | 8/1966 | McConnell | 211/148 |
| 3,273,720 | 9/1966 | Seiz | 211/148 |
| 3,700,114 | 10/1972 | Myers | 211/150 |
| 3,795,379 | 3/1974 | Gray | 248/242 |
| 3,827,376 | 8/1974 | Solomon | 108/91 |
| 3,841,237 | 10/1974 | Plymate | 108/6 |
| 4,627,542 | 12/1986 | Fredrickson | 211/150 |
| 4,785,946 | 11/1988 | Sorensen | 211/187 |
| 4,805,787 | 2/1989 | Gillotte | 211/191 |
| 5,127,340 | 7/1992 | Maro et al. | 108/107 |
| 5,607,070 | 3/1997 | Hellyer | 211/189 |
| 5,816,419 | 10/1998 | Lamson | 211/150 |
| 5,921,190 | 7/1999 | Wood | 108/106 X |

FOREIGN PATENT DOCUMENTS

| | | | |
|---|---|---|---|
| 23063 | 4/1913 | United Kingdom | 108/110 |

OTHER PUBLICATIONS

Garcy Product Literature "Face–Outs," estimated Jun. 1997.

Capitol Hardware Company Hangrod Faceout Product Literature, estimated Mar. 1997.

*Primary Examiner*—Jose V. Chen

*Attorney, Agent, or Firm*—Quarles & Brady, LLP

[57] ABSTRACT

In the combination of a shelf and a shelf-supporting apparatus, the shelf has a longitudinal axis and an end surface coincident with such axis. The apparatus supports the shelf at the shelf end surface. In the improvement, the shelf includes first and second support pins extending from the end surface in a direction parallel to the axis. These support pins define a first spacing dimension. The apparatus includes a support member having a first or forward slot and a second or rearward slot. Each slot has a pin-support portion with a clearance region therebetween. The clearance region has first and second boundaries, the second slot includes a pivot portion and the pivot portion and the first boundary define a second spacing dimension slightly greater than the first spacing dimension. The combination is adaptable to a wide variety of shelf types and has particular utility when used in a store fixture for retail display of articles offered for sale.

12 Claims, 7 Drawing Sheets

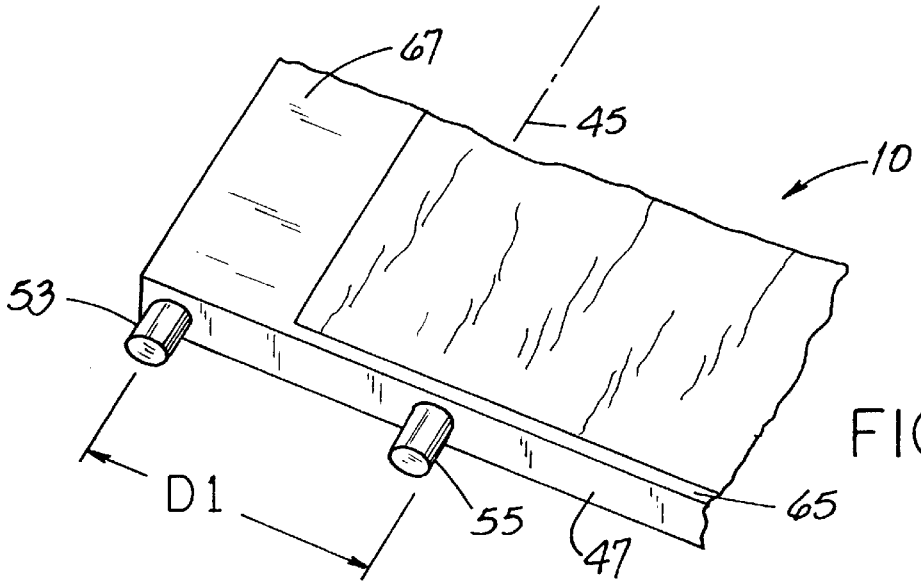
FIG. 7
FIG. 8
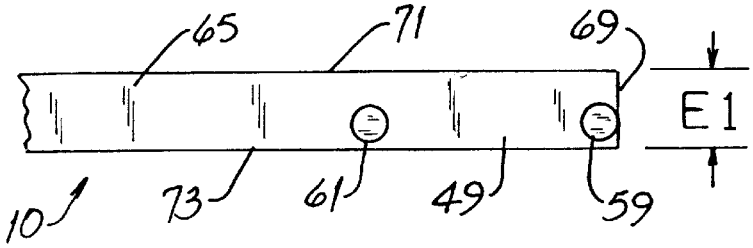
FIG. 9
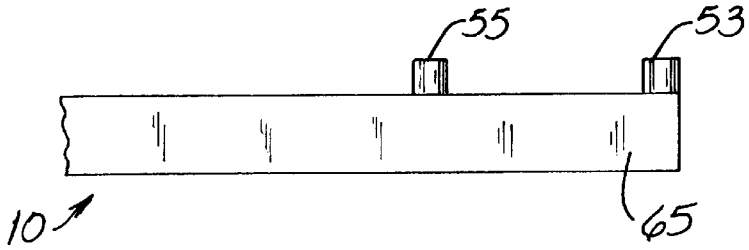
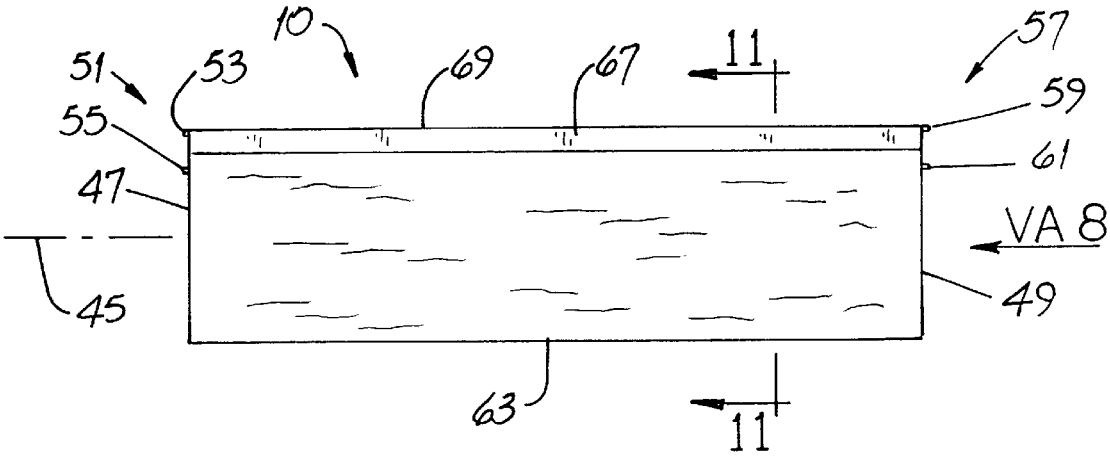
FIG. 10

SUPPORT AND RELATED SHELF

FIELD OF THE INVENTION

This invention relates generally to racks and rack-type supports having horizontal planar surfaces and, more particularly, to such racks and supports of the type having a removable shelf.

BACKGROUND OF THE INVENTION

It is well recognized that a wide variety of racks and rack-type supports are known. Examples of but a few types are disclosed in U.S. Pat. Nos. 1,805,989 (Levene), U.S. Pat. No. 1,990,756 (Saaf), U.S. Pat. No. 5,127,340 (Maro et al.) and U.S. Pat. No. 5,607,070 (Hellyer). While these arrangements have been generally satisfactory for their intended purposes, they are not without disadvantages for certain applications.

For example, the shelves disclosed in the Levene patent must be bolted in place and unbolted to be removed and, if desired, stored. Where time has value, as is usually the case in a work environment, the arrangement is cumbersome. While the shelves disclosed in the Saaf patent may be more quickly mounted and removed, that convenience requires a shelf having pins mounted for pivoting movement into and out of supporting holes.

For greatest flexibility in erection, use and "tear-down," a scaffold should have a shelf-like platform which can be readily mounted and, just as readily, removed. Home entertainment centers, another type of product having one or more shelves, are most preferably configured so that the vertical spacing between shelves can be selected consistent with the vertical height of the components, e.g., tuner, compact-disc player, amplifier or the like, which are intended to rest upon such shelves. Structures like that disclosed in the Levene patent do not lend themselves easily to such uses.

Another type of rack with one or more shelves are embodied as mounted or freestanding units used to display retail products for sale. Such units are often referred to in the industry as "store fixtures." Most preferably, stores fixtures should be aesthetically attractive, permit easy reconfiguration for displaying any of a variety of types of products and have features easily adapted to integration of advertising graphics or the like.

An improved support and shelf which responds to needs described above would be an important advance in this field of technology.

OBJECT OF THE INVENTION

It is an object of the invention to provide an improved support and shelf which addresses problems and shortcomings of the prior art.

Another object of the invention is to provide an improved support and shelf arrangement which can be quickly reconfigured.

Another object of the invention is to provide an improved support and shelf arrangement which permits rapid mounting and de-mounting of a shelf.

Yet another object of the invention is to provide an improved support and shelf arrangement which permits "self-storing" of a shelf.

Another object of the invention is to provide an improved support and shelf arrangement which, in particular embodiments, involves a store fixture. How these and other objects are accomplished will become apparent from the following descriptions and from the drawings.

SUMMARY OF THE INVENTION

The invention involves the combination of a shelf having a longitudinal axis and an end surface coincident with such axis. It also involves an apparatus for supporting the shelf at such end surface. In the improvement, the shelf includes first and second support pins extending from the end surface in a direction parallel to the axis and defining a first spacing dimension. The apparatus includes a support member having first and second slots, each with a pin-support portion. A clearance region is between such pin-support portions and between the slots.

The clearance region has first and second boundaries and the second slot includes a pivot portion. Such pivot portion and the first boundary define a second spacing dimension slightly greater than the first spacing dimension.

More specifically, the pin-support portion of the first slot is shaped to conform to the shape of the first support pin. And the second pin is arcuate as is the pivot portion of the second slot. In a highly preferred embodiment, the support member is vertical and when the first and second support pins are in registry with the pin-support portions of the first and second slots, respectively, the shelf extends along a substantially horizontal plane.

As to other relationships of components of the new combination, when the second support pin is in registry with the pivot portion of the second slot, the shelf is angled with respect to the horizontal plane. And when such second support pin is in registry with the pivot portion of the second slot and when the shelf is angled with respect to the horizontal plane, the first support pin is spaced below the pin-support portion of the first slot.

In a specific embodiment suitable for self-storing of shelves on the support member, the apparatus has a third slot spaced below the first slot and a fourth slot spaced below the second slot. When the second support pin is in registry with the pivot portion and the shelf is angled with respect to the horizontal plane, e.g., perpendicular to such plane, the first support pin is in the fourth slot.

And the new combination of the shelf and support apparatus has yet additional features when further combined with a hang bar. More specifically, the shelf has an edge defining an edge dimension and the hang bar has a mounting bracket defining a bracket dimension slightly greater than the edge dimension. When the shelf edge and hang bar mounting bracket are so configured, the hang bar may be mounted securely on the shelf by slipping the mounting bracket downwardly over the shelf edge.

A particular embodiment of the invention is configured as a store fixture having plural shelves on which products, e.g., dry goods, may be displayed for sale. Such store fixture has an upright frame with first and second end stanchions. First and second lateral support members fixed with respect to the frame and, specifically, are fixed with respect to the first and second stanchions, respectively. Each support member has a plurality of vertically spaced slot sets, each slot set including first and second slots. Each of the first and second slots of each slot set has a pin-support portion and a clearance region is between the slots.

A plurality of shelves is mounted between the support members and each shelf has a longitudinal axis and a pair of spaced end surfaces coincident with such axis. Each shelf end surface has first and second support pins extending axially from it. The support pins at each end surface of each shelf define a first spacing dimension.

Further, each of the clearance regions has first and second boundaries and each of the second slots includes a pivot portion. As to the first lateral support member, the pivot portions of each of its second slots and its first boundary define a second spacing dimension slightly greater than the first spacing dimension.

The new store fixture is preferably configured to permit storing, out of sight, unused shelves. Such fixture includes a storage section between the lateral support members. The storage section has a pair of spaced wall members extending between the stanchions. In the preferred fixture, there is at least one support device, e.g., a shelf-like "rail" or the like, extending between and affixed to the wall members. The wall members and the support device form an elongate storage tunnel for receiving a shelf therein for storage.

The fixture also has an end closure mounted for movement with respect to the frame, thereby permitting the storage tunnel to be opened and closed. Most preferably, the end closure is mounted for pivoting movement about a vertical axis and includes an exterior panel formed of a material which is either translucent or transparent so that light can be transmitted therethrough. An interior panel supports a lamp, the light from which is visible through the exterior panel.

And that is not all. The preferred new store fixture also has, in addition to the backlighted exterior panel, other features permitting use of visual graphics. The spaced wall members also define a vertically-oriented gap between them. An aesthetically pleasing closure member is atop the gap. There is a sign board mounted for vertical movement with respect to the closure member, thereby configuring the sign board to be displayed above the closure member or received in the gap for storage.

Other details of the invention are set forth in the following detailed description and in the drawings.

BRIEF DESCRIPTIONS OF THE DRAWINGS

FIG. 7 is a perspective view of a shelf used in the store fixture of FIGS. 1 through 6. Parts are broken away.

FIG. 8 is an end view of the shelf of FIGS. 7 and 10 taken along the viewing axis VA8 of FIG. 10. Parts are broken away.

FIG. 9 is a top plan view of a portion of a metal edge member used in the shelf of FIG. 7. Parts are broken away.

FIG. 10 is a top plan view of the shelf of FIG. 7.

DETAILED DESCRIPTIONS OF PREFERRED EMBODIMENTS

Figure 1:
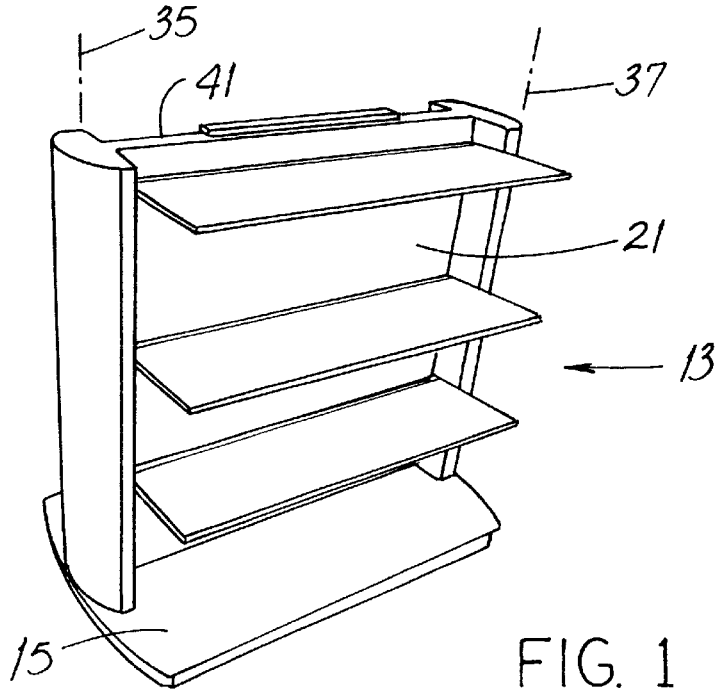
FIG. 1 is a perspective view of a store fixture with shelves erected for product display, with both end closures closed and with a sign board in the lowered positions.

Referring first to FIGS. 1 through 10, aspects of the invention involve a shelf 10 and apparatus 11 for supporting the shelf 10 at each shelf end surface. The invention will be described in connection with an embodiment involving a store fixture 13. The overall arrangement of the fixture 13 will be described first and this is followed by more detailed descriptions of specific features.

The fixture 13, shown in FIGS. 1 through 6, includes a generally planar base 15 optionally equipped with casters 17 for easy relocation from place to place. A frame 19 is rigidly affixed to and extends vertically upwardly from the base 15. The frame 19 includes substantially flat first and second wall members 21 and 23, respectively. While a single wall member may be used, two spaced-apart wall members are preferred for reasons that will become apparent.

The frame 19 also includes lateral support members configured as first and second end stanchions 25 and 27, respectively. Each of the wall members 21, 23 extends between and is rigidly affixed to the stanchions 25, 27.

Conveniently, the fixture 13 has a storage section 29 which, when considered from left to right, is between the stanchions 25, 27. Considered from front to rear, such section 29 is between the wall members 21, 23.

At least for reasons of better aesthetics, the storage section 29 is covered by first and second end closures 31, 33; respectively. Most preferably, such closures 31, 33 are pivot mounted to the first and second end stanchions 25, 27, respectively, and swing open and closed along vertical axes 35, 37, respectively. The end closures 31, 33 are preferably configured to include backlighting and/or some sort of graphic treatment as a sales aid, both as further described below.

Figure 2:
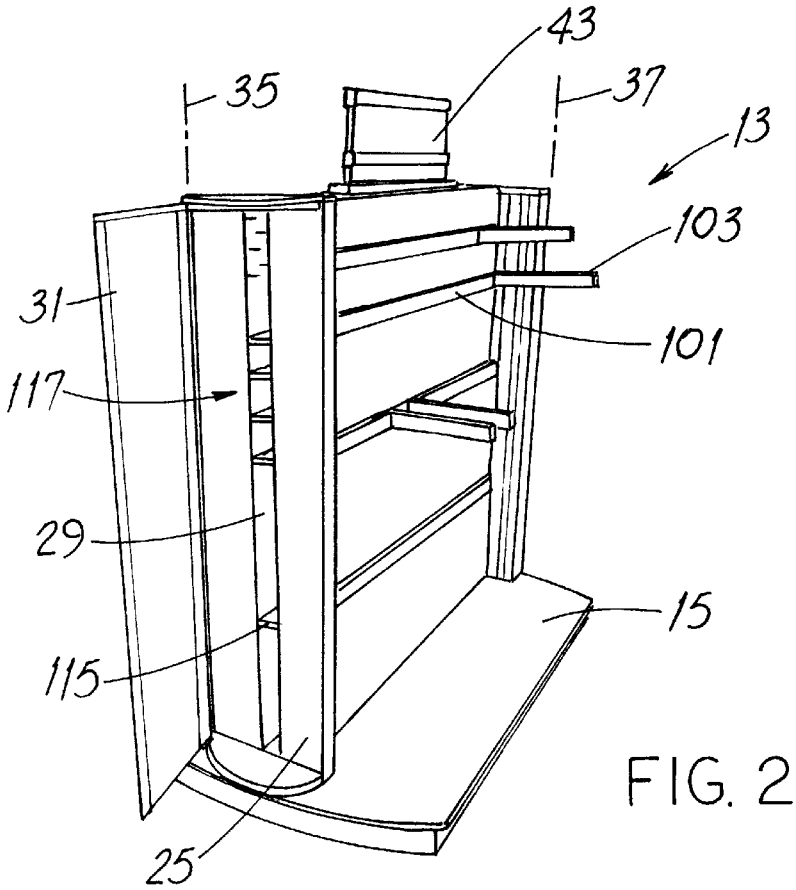
FIG. 2 is a perspective view of a store fixture generally like that of FIG. 1 but with an end closure open, the sign board in the raised position and with hang bar supports and mounting brackets installed in place of shelves.
Figure 3:
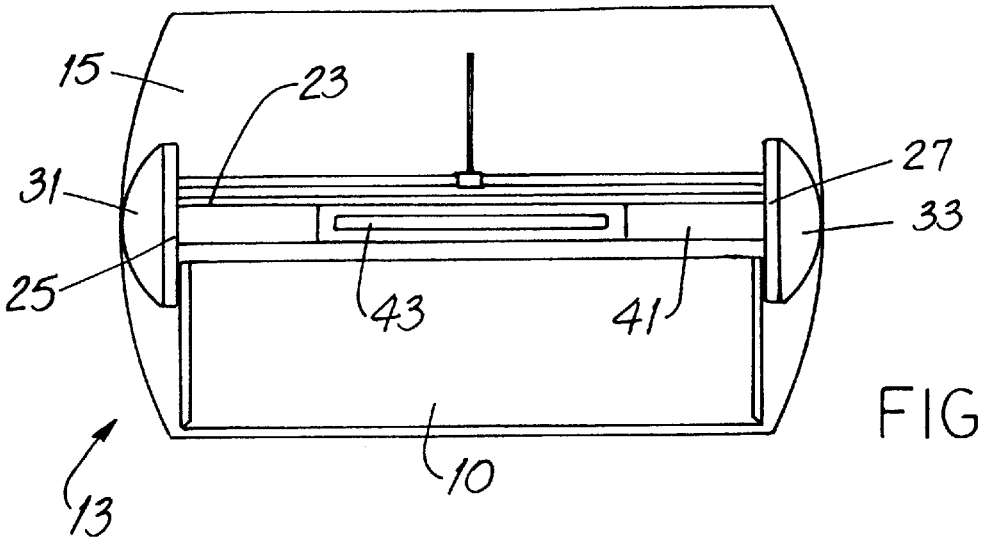
FIG. 3 is a top plan view of the store fixture of FIG. 1.
Figure 4:
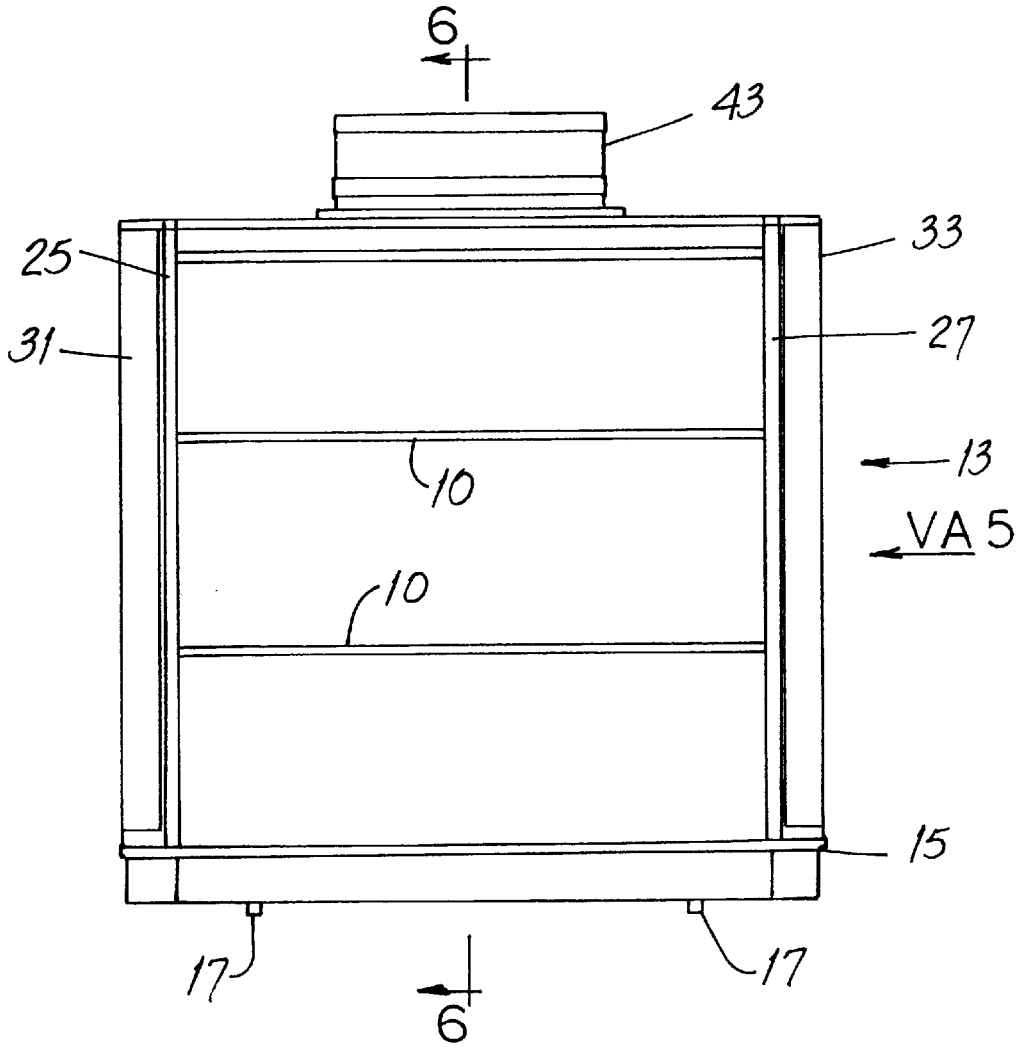
FIG. 4 is a front elevation view of the store fixture of FIG. 1 with the sign board raised.

The spaced wall members 21, 23 define a vertically-oriented gap 39 between them and an aesthetically pleasing closure member 41 is atop the gap 39 for gap closure. The fixture 13 has a sign board 43 mounted for vertical movement with respect to the closure member 41, thereby configuring the sign board 43 to be pulled upwardly and displayed above the closure member as shown in FIG. 2 or depressed downwardly and received in the gap 39 for storage as shown in FIG. 1. Details of the shelf 10 and shelf support apparatus 11 will now be set forth.

Referring to FIGS. 7 through 11, the shelf 10 has a longitudinal axis 45 and first and second substantially flat end surfaces 47, 49, respectively, which are coincident with such axis 45 and perpendicular thereto. The shelf has a first pair 51 of support pins, i.e., pins 53 and 55, extending from the first end surface 47. Similarly, the shelf 10 has a second pair 57 of support pins, i.e., pins 59 and 61, extending from the second end surface 49. As to those pins comprising one of the pairs, e.g., pair 51 and pins 53 and 55, such pins are also referred to herein as first and second pins 55, 53, respectively. (As to a particular pair 51 of 57, the pin 55 or 61 closer to the shelf outward edge 63 is identified as the first pin.) The pins 53, 55, 59, 61 extend in directions parallel to the axis 45 and as to those pins comprising the first or second pair, e.g., pins 53 and 55, such pins define a first spacing dimension D1 between the center of pin 53 and the edge of pin 55 which faces in a direction opposite pin 53 (i.e., facing away from pin 53). Referring particularly to FIGS. 7, 8, 9 and 11, a highly preferred shelf 10 is made of wood or of a wood product (e.g., veneered particle board or a laminate) and each pair of pins such as pair 51 is integral with a metal edge member 65. The end surfaces 47, 49 are those of respective edge members 65. A U-shaped stiffer 67 extends along that edge 69 of the shelf 10 which is rearward when the shelf 10 is erected for product display. As shown in FIG. 8, the stiffener 67 defines an edge dimension E1 and the significance of such dimension E1 is further described below.

Considering FIGS. 8 and 10, it is apparent that as to a particular pair 57 of pins, e.g., the pins 59 and 61, the shelf edge 69 is tangent to the second pin 59 and both pins 59, 61 are spaced equidistant from the shelf top surface 71 or bottom surface 73. This specific configuration is preferred for reasons relating to manufacturing expediency. However, as further described below, other pin locations are possible without departing from the spirit of the invention.

Figure 6:
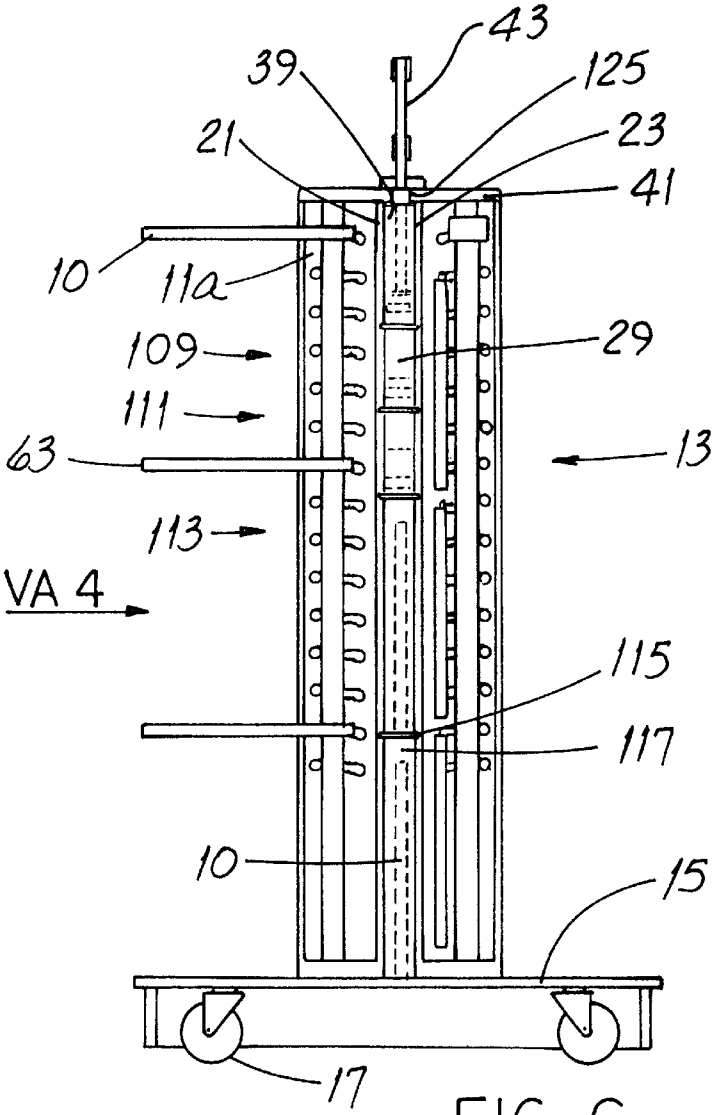
FIG. 6 is a sectional view of the store fixture of FIG. 4 taken along the viewing plane 6—6 thereof.
Figure 5:
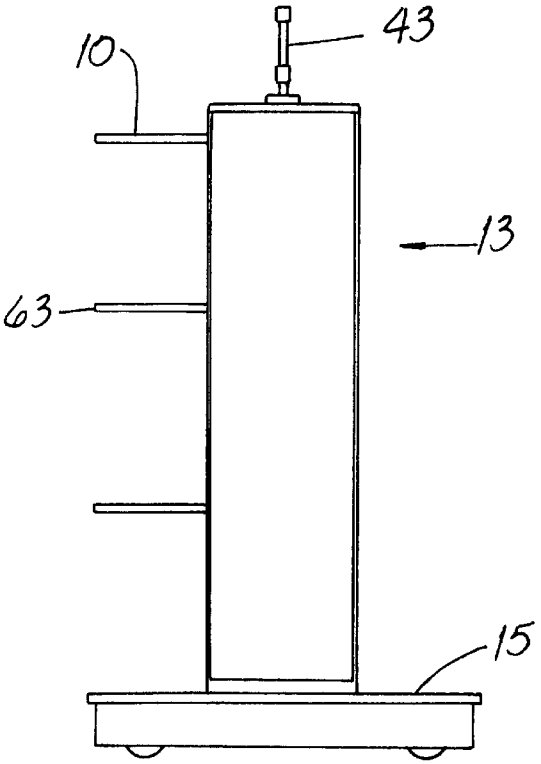
FIG. 5 is an end elevation view of the store fixture of FIG. 4 taken along the viewing axis VA5 thereof.
Figure 11:
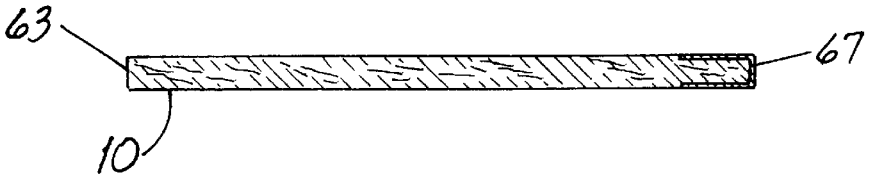
FIG. 11 is a section view of the shelf of FIG. 10 taken along the viewing plane 11—11 thereof.
Figure 17:
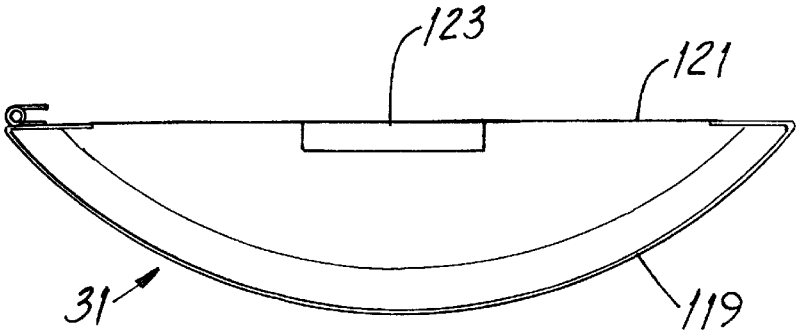
FIG. 17 is a downwardly looking section view of one of the store fixture end closures.
Figure 18:
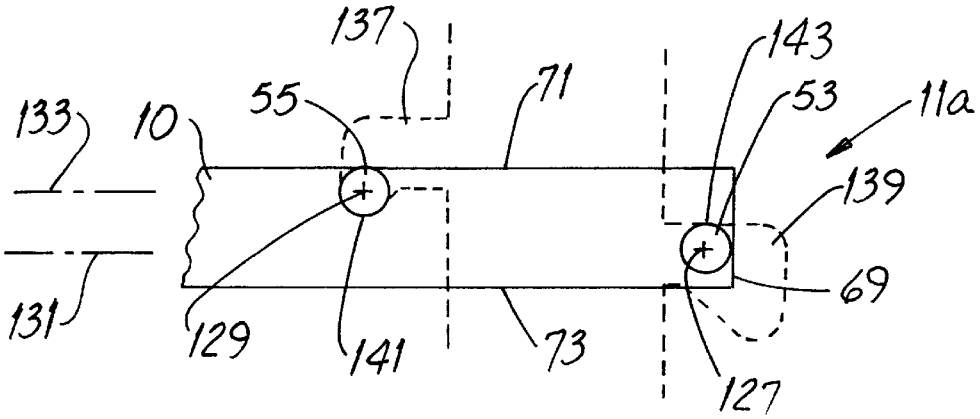
FIG. 18 shows, in dashed outline, another embodiment of a support apparatus having slot locations differing from the slot locations shown in, e.g., FIGS. 13–16. Another embodiment of a shelf and two of its support pins are shown in solid outline and parts of the shelf are broken away.
Figure 12:
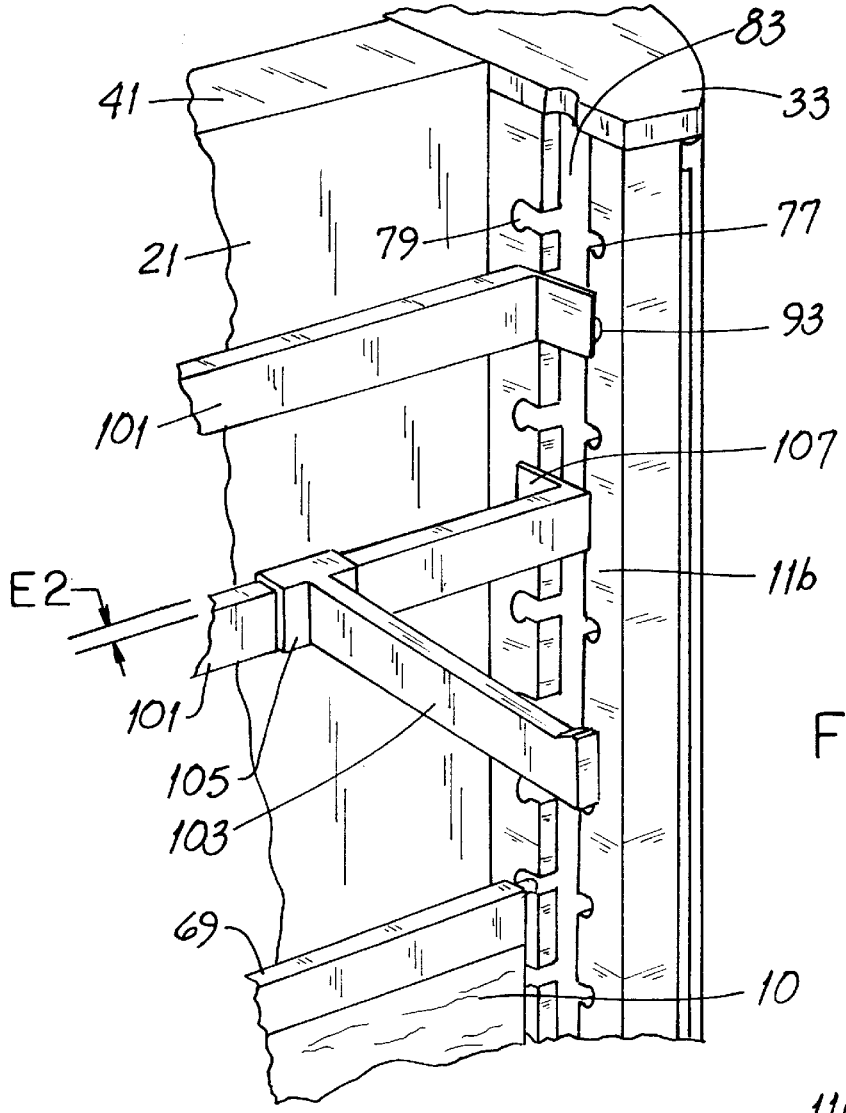
FIG. 12 is a perspective view of a portion of the store fixture. Parts are broken away.
Figure 15:
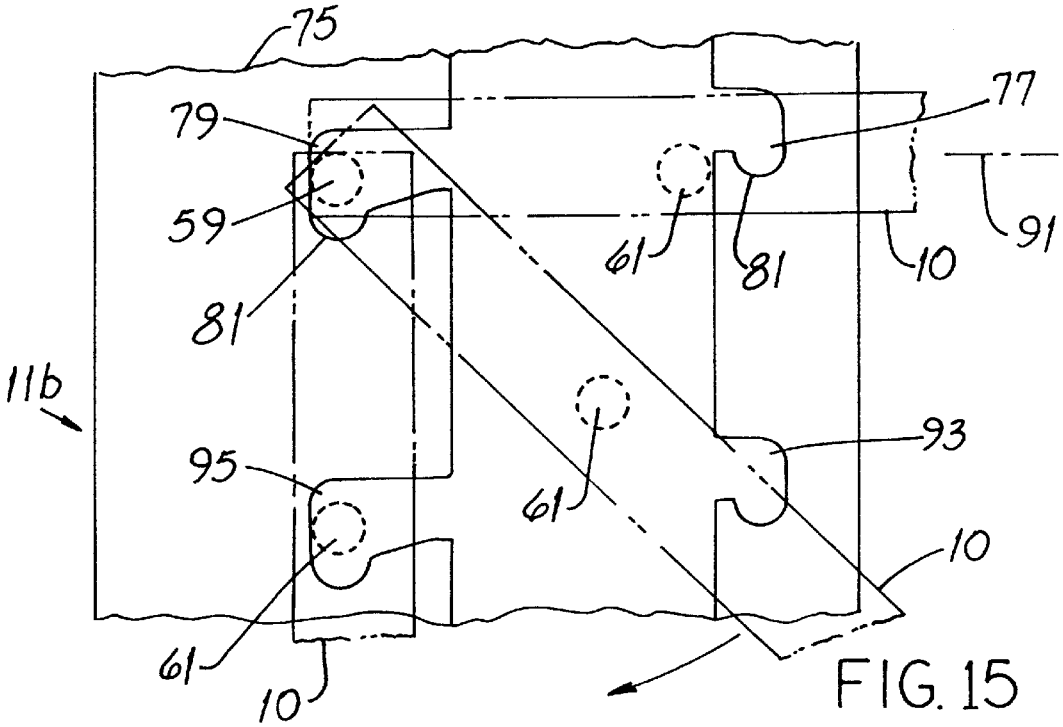
Figure 16:
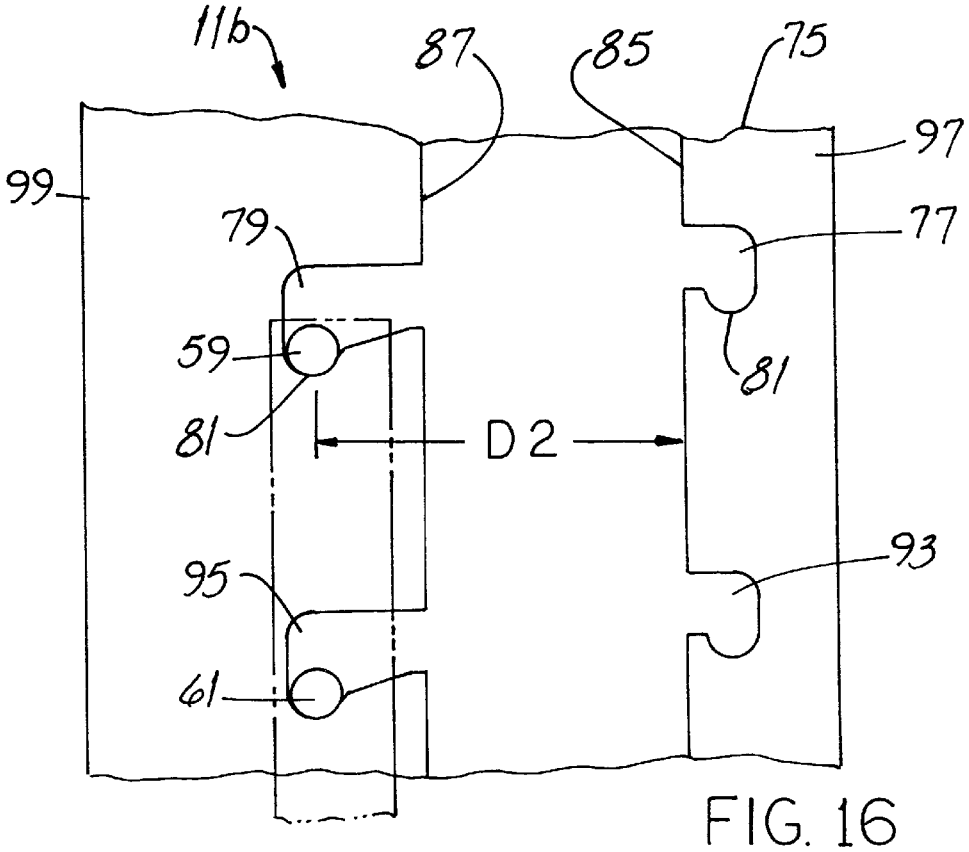

Referring next to FIGS. 6 and 12 through 16, the invention also involves a separate apparatus 11*a*, 11*b* for supporting the shelf at each end surface 47, 49. In the store fixture 13, the apparatuses 11*a*, 11*b* are mirror images of one another and are shown in FIGS. 6 and 12, respectively. Therefore, it is necessary to describe only one of the apparatus 11*a* or 11*b* and the latter is described below. The apparatus 11*b* includes a support member 75 having first and second slots 77 and 79, respectively. Each slot 77, 79 has a pin-support portion 81. A rectangularly shaped, "channel-like" clearance region 83 is between such pin-support portions 81 and between the slots 77, 79. The clearance region has first and second boundaries 85 and 87, respectively, and the second slot 79 includes a pivot portion 89. The pin support portions define a spacing dimension essentially equal to the first spacing dimension D1. As shown in FIG. 16, such pivot portion 89 and the first boundary 85 define a second spacing dimension D2 slightly greater than the first spacing dimension D1 Dimension D2, as illustrated, is between the middle of pivot portion 89 (see FIG. 13) and the nearest portion of facing first boundary 85.

As to other aspects of the invention, the pin-support portion 81 of the first slot 77 is shaped to conform to the shape of the first support pin 61. In a specific embodiment, the pin-support portion 81 of the first slot 77 defines an arc of a circle and the first support pin 61 is circular in cross-section and has about the same radius of curvature as the portion 81 of such first slot 77.

The pivot portion 89 of the second slot 79 is arcuate as is the second pin 59. (Most preferably, the pin 59 is cylindrical.) In a highly preferred embodiment, the support member 75 is vertical and when the first and second support pins 61, 59 are in registry with the pin-support portions 81 of the first and second slots 77, 79, respectively, the shelf 10 extends along a substantially horizontal plane 91.

Figure 13:
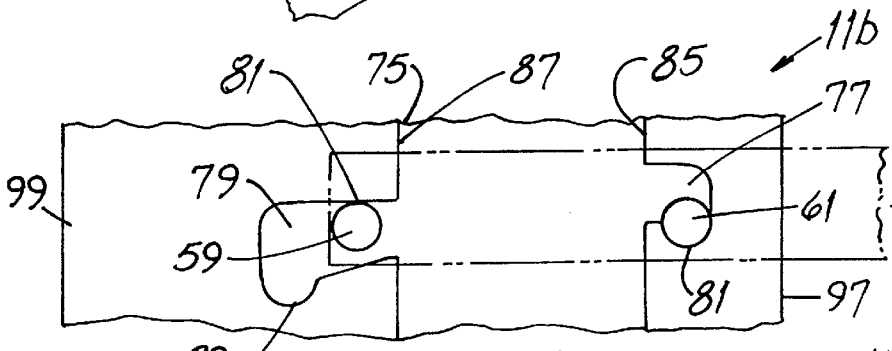
FIGS. 13, 14, 15 and 16 show, in solid outline, one of the two shelf support apparatus used in the store fixture. Sequential positions of a shelf are shown in dashed outline in such FIGS.
Figure 14:
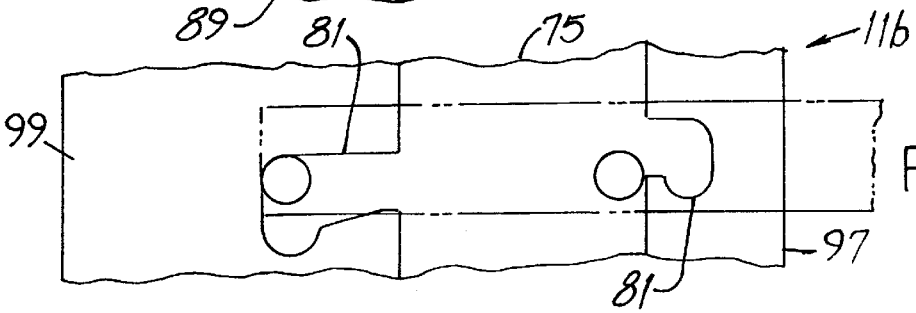

Considering FIGS. 13 through 16, and particularly FIGS. 13 and 15, when the second support pin 59 is in registry with the pivot portion 81 of the second slot 79 and when the shelf 10 is being pivoted downwardly for shelf storage or pivoted upwardly for product display, the shelf 10 is angled with respect to the horizontal plane 91. And when such second support pin 59 is in registry with the pivot portion 81 of the second slot 79 and the shelf 10 is angled with respect to the horizontal plane 91 as shown in FIGS. 15 and 16, the first support pin 61 is spaced below the pin-support portion 81 of the first slot 77.

Referring to FIGS. 12, 15 and 16, a specific embodiment is suitable for self-storing shelves 10 on the support member 75. In such embodiment, the apparatus 11*b* has a third slot 93 spaced below the first slot 77 and a fourth slot 95 spaced below the second slot 79. When the second support pin 59 is in registry with the pivot portion 81 of slot 79 and the shelf 10 is angled with respect to the horizontal plane, e.g., perpendicular to such plane 91, the first support pin 61 is in the fourth slot 95. To describe this configuration in less geometric terms, the first support pin 61 aligns with and "swings into" the fourth slot 95 and the shelf 10 is re-oriented from horizontal to a self-storing vertical position. To describe it in yet other terms, the pins 59, 61 are in the slots 79, 95, respectively, and the shelf 10 "hangs" vertically from the pins 59, 61 (as well as, of course, from the pins 53, 55.

Considering FIGS. 6 and 12–16, the support apparatus 11*b* may be configured in any of several different ways. In a preferred embodiment, the apparatus 11*b* has forward and rearward support strips 97 and 99, respectively. Such strips 97, 99 are separately mounted and located so that the clearance region 83 is of the desired dimension consistent with the relationship between dimensions D1 and D2 described above. However, the apparatus 11*b* may also be configured as a unitary piece which includes the support strips 97, 99 and the clearance region 83 therebetween.

Some fixture users may prefer to display certain types brackets 103 of products, e.g., neckties, purses, belts or the like, by hanging them on hang bar brackets 103 rather than laying them upon shelves 10. Referring now to FIGS. 2, 8, 11 and 12, the new combination of the shelf 10 and support apparatus 11 readily accommodates that preference. A hang bar bracket 103 has an inverted U-shaped bar attachment member 105 defining a dimension E2 only slightly greater than the edge dimension E1. When the shelf edge 69 and bracket 103 are so configured and when the shelf 10 is in a downward, self-stored position as shown in FIGS. 12 and 16, the bracket 103 may be mounted securely on the shelf 10 by slipping the member 105 downwardly over the shelf edge 69. (Considering FIG. 12, it is also to be appreciated that one or more brackets 103 may be mounted on a hang bar support 101 having end plates 107, each with a pair of pins as described above with respect to the shelf 10.)

Referring to FIGS. 1, 3, 4, 5 and 6, where the store fixture 13 preferably has plural shelves 10 on which products, e.g., dry goods, may be displayed for sale, each support apparatus 11*a*, 11*b* has a plurality of vertically spaced slot sets such as sets 109, 111 and 113. Each slot set 109, 111, 113 includes first and second slots such as 77, 79, respectively, as described above. And as also described above, each of the first and second slots of each slot set 109, 111, 113 has a pin-support portion 81 and a clearance region 83 between the slots. Each shelf 10 of plural shelves 10 and the shelf support apparatus 11 are configured as described above.

As mentioned above, the new store fixture 13 is preferably configured to permit storing, out of sight, unused shelves 10. Referring to FIGS. 2, 3, 4 and 6, the fixture 13 includes the storage section 29 between the lateral stanchions 25, 27. The storage section 29 has the pair of spaced wall members 21, 23 extending between the stanchions 25, 27. In the preferred fixture 13, there is at least one support device 115, e.g., a horizontal, shelf-like "rail" or the like, extending between and affixed to the wall members 21, 23. The wall members 21, 23 and the support device 115 form an elongate storage tunnel 117 for receiving a shelf 10 therein for storage. The end closures 31, 33 permit the storage tunnel 117 to be opened for shelf removal or storage and closed to restore the aesthetic quality of the fixture 13 and to prevent possible shelf theft.

Referring also to FIGS. 2, 3, 4, 12 and 17, each end closure 31, 33 includes an arcuate exterior panel 119 formed of a material which is either translucent or transparent so that light can be transmitted therethrough. An interior panel 121 supports a lamp 123, the light from which is visible through the exterior panel 119. Sales-related text, images or both may be applied to such panel 119.

Referring now to FIGS. 3, 4, 6 and 12, the spaced wall members 21, 23 define a gap 39 between them. An aesthetically pleasing closure member 41, e.g., a finished wood strip or the like is atop the gap 39 and, front to rear, extends between the wall members 21, 23. A vertically sliding sign board 43 extends through a slot 125 in the closure member 41. The sign board 43 can be withdrawn and displayed above the closure member 41 or pushed downwardly into the gap 39 for storage.

FIGS. 6–10 and 12–16 show the preferred pin configuration and pin locations. But, as noted above, other pin locations are possible. Referring to FIGS. 6, 8, 10 and 18 (which show the apparatus 11*a* which is to the viewer's left when such viewer is viewing the fixture 13 along the viewing axis VA of FIG. 6), the first pin 55 is located so that the top surface 71 of the shelf 10 is tangent therewith and the second pin 53 is located so that the shelf edge 69 is tangent thereto and the pin 53 is closely proximate the shelf bottom surface 73. To state it another way (and when the shelf 10 is horizontal), the pin center axes 127, 129 are coincident with separate horizontal planes 131, 133, respectively, which are vertically spaced apart.

The first and second slots 137, 139, respectively, are relatively located so that when the pins 53, 55 are in the pin support portions 143, 141 of such slots 139, 137, respectively, the shelf 10 is horizontal. From the foregoing, it is apparent that shelves 10 of differing thickness and having pins differently located thereon can nevertheless be accommodated by appropriate slot location.

As used herein, the term "support pin" and like terms means any structural component protruding from a shelf end surface for shelf support. Unless the context requires otherwise, a support pin may have any crosssectional shape. For ease of manufacture and use, support pins with circular cross-sectional shapes are highly preferred.

Unless the context requires otherwise as, e.g., in the case of a shelf 10 and support apparatus 11*a*, 11*b* which are part of a retail store fixture for displaying products for sale, the term "shelf" means a generally planar structure supporting or capable of supporting persons or things. As non-limiting examples, a worker's scaffold, a household closet, an entertainment center and a store display fixture 13 would all include a shelf.

While the principles of the invention have been shown and described in connection with preferred embodiments, it is to be understood clearly that such embodiments are by way of example and are not limiting.

What is claimed:

1. In the combination of (a) a shelf having a longitudinal axis and an end surface coincident with such axis, (b) an apparatus for supporting the shelf at such end surface and a hang bar, the improvement wherein:

the shelf includes first and second support pins extending from the end surface in a direction parallel to the axis and defining a first spacing dimension D1 between the center of the first pin and an edge of the second pin which faces away from the first pin;

and wherein:

the apparatus includes a support member having first and second slots, each with a pin-support portion having a clearance region therebetween, the support portions defining a spacing dimension essentially equal to the first spacing dimension;

the clearance region has first and second boundaries;

the second slot includes a pivot portion; and the pivot portion and the first boundary define a second spacing dimension D2 slightly greater than the first spacing dimension, the second spacing dimension D2 between the middle of the pivot portion and the nearest portion of the facing first boundary.

2. The combination of claim 1 wherein the pin-support portion of the first slot is shaped to conform to the shape of the first support pin.

3. The combination of claim 2 wherein the second pin is arcuate and the pivot portion is arcuate.

4. The combination of claim 1 wherein:

the support member is vertical;

when the first and second support pins are in registry with the pin-support portions of the first and second slots, respectively, the shelf extends along a substantially horizontal plane; and when the second support pin is in registry with the pivot portion, the shelf is angled with respect to the horizontal plane.

5. The combination of claim 4 wherein:

when the second support pin is in registry with the pivot portion and the shelf is angled with respect to the horizontal plane, the first support pin is spaced below the pin-support portion of the first slot.

6. The combination of claim 5 wherein:

the apparatus has a third slot spaced below the first slot and a fourth slot spaced below the second slot; and when the second support pin is in registry with the pivot portion and the shelf is angled with respect to the horizontal plane, the first support pin is in the fourth slot.

7. In the combination of (a) a shelf having a longitudinal axis and an end surface coincident with such axis, (b) an apparatus for supporting the shelf at such end surface and a hang bar, the improvement wherein:

the shelf includes first and second support pins extending from the end surface in a direction parallel to the axis and defining a first spacing dimension D1 between the center of the first pin and an edge of the second pin which faces away from the first pin, the shelf has an edge defining an edge dimension;

the hang bar has a mounting bracket defining a bracket dimension slightly greater than the edge dimension, thereby configuring the hang bar to be mounted on the shelf;

and wherein:

the apparatus includes a support member having first and second slots, each with a pin-support portion having a clearance region therebetween, the support portions defining a spacing dimension essentially equal to the first spacing dimension;

the clearance region has first and second boundaries;

the second slot includes a pivot portion; and the pivot portion and the first boundary define a second spacing dimension D2 slightly greater than the first spacing dimension, the second spacing dimension D2 between the middle of the pivot portion and the nearest portion of the facing first boundary.

8. A store fixture including:

first and second lateral support members fixed with respect to the frame, each support member having a plurality of slot sets, each slot set including first and second slots, each of the first and second slots of each slot set having a pin-support portion with a clearance region therebetween;

a plurality of shelves mounted between the support members, each shelf having a longitudinal axis and a pair of spaced end surfaces coincident with the longitudinal axis, each end surface having first and second support pins extending axially therefrom;

and wherein:

the support pins at each end surface of each shelf define a first spacing dimension D1 between the center of the first pin and an edge of the second pin which faces away from the first pin;

each of the clearance regions has first and second boundaries;

each of the second slots includes a pivot portion, the support portions defining a spacing dimension essentially equal to the first spacing dimension; and as to the first lateral support member, the pivot portions of each of its second slots and its first boundary define a second spacing dimension D2 slightly greater than the first spacing dimension, the second spacing dimension D2 between the middle of the pivot portion and the nearest portion of the facing first boundary.

9. A store fixture including a frame;

first and second lateral support members fixed with respect to the frame, each support member having a plurality of slot sets, each slot set including first and second slots, each of the first and second slots of each slot set having a pin-support portion with a clearance region therebetween;

a plurality of shelves mounted between the support members, each shelf having a longitudinal axis and a pair of spaced end surfaces coincident with the longitudinal axis, each end surface having first and second support pins extending axially therefrom;

a storage section between the lateral support members, such storage section including a pair of spaced wall members and at least one support device between the wall members for receiving a stored shelf thereon;

and wherein:

the support pins at each end surface of each shelf define a first spacing dimension D1 between the center of the first pin and an edge of the second pin which faces away from the first pin;

each of the clearance regions has first and second boundaries;

each of the second slots includes a pivot portion, the support portions defining a spacing dimension essentially equal to the first spacing dimension; and as to the first lateral support member, the pivot portions of each of its second slots and its first boundary define a second spacing dimension D2 slightly greater than the first spacing dimension, the second spacing dimension D2 between the middle of the pivot portion and the nearest portion of the facing first boundary.

10. The store fixture of claim 9 wherein the wall members and the support device form an elongate storage tunnel and wherein:

the fixture has an end closure mounted for movement with respect to the frame, thereby permitting the storage tunnel to be opened and closed.

11. The store fixture of claim 10 wherein the end closure is mounted for pivoting movement about a vertical axis and includes:

an exterior panel formed of a material which transmits light therethrough; and an interior panel supporting a lamp, the light from which is visible through the exterior panel.

12. The store fixture of claim 8 including:

a pair of spaced wall members between the lateral support members and defining a vertically-oriented gap therebetween;

a closure member atop the gap; and a sign board mounted for vertical movement with respect to the closure member, thereby configuring the sign board to be displayed above the closure member or received in the gap for storage.

* * * * *